US008943813B2

(12) United States Patent
Kamei et al.

(10) Patent No.: US 8,943,813 B2
(45) Date of Patent: Feb. 3, 2015

(54) EXHAUST GAS PURIFYING DEVICE FOR INTERNAL COMBUSTION ENGINE

(75) Inventors: Toshiyuki Kamei, Oyama (JP); Hiroshi Yamamoto, Oyama (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 167 days.

(21) Appl. No.: 13/259,298

(22) PCT Filed: Mar. 23, 2010

(86) PCT No.: PCT/JP2010/054932

§ 371 (c)(1),
(2), (4) Date: Sep. 23, 2011

(87) PCT Pub. No.: WO2010/110242

PCT Pub. Date: Sep. 30, 2010

(65) Prior Publication Data

US 2012/0011833 A1 Jan. 19, 2012

(30) Foreign Application Priority Data

Mar. 26, 2009 (JP) ..... 2009-076698

(51) Int. Cl.
*F01N 3/02* (2006.01)
*E02F 9/08* (2006.01)
(Continued)

(52) U.S. Cl.
CPC ..... *E02F 9/0866* (2013.01); *F01N 13/1805* (2013.01); *F01N 13/1855* (2013.01); *F01N 13/0097* (2014.06); *F01N 2450/30* (2013.01); *F01N 2470/18* (2013.01)
USPC ..... 60/311; 60/286; 60/295

(58) Field of Classification Search
CPC ..... E02F 9/0866; F01N 13/0097; F01N 13/1805; F01N 13/1855; F01N 2450/30; F01N 2470/18
USPC ..... 60/286, 295, 297, 299, 311, 324; 138/106, 107, 109; 285/368, 412, 415
See application file for complete search history.

(56) References Cited

U.S. PATENT DOCUMENTS 1,525,647 A * 2/1925 Haughey ..... 285/412
2,784,989 A * 3/1957 Krupp ..... 285/236
(Continued)

FOREIGN PATENT DOCUMENTS

JP 2002070077 A * 3/2002 ..... E02F 9/18
JP 2003-120277 A 4/2003
(Continued)

OTHER PUBLICATIONS

International Search Report mailed Jun. 15, 2010 in International Application No. PCT/JP2010/054932, 2 pages.

*Primary Examiner* — Thomas Denion
*Assistant Examiner* — Matthew T Largi
(74) *Attorney, Agent, or Firm* — Fish & Richardson P.C.

(57) ABSTRACT

An exhaust gas purifying device for an internal combustion engine includes an inflow case provided with an inlet pipe, a catalyst case in which an oxidizing catalyst for dosing is housed, a filter case in which a soot filter is housed, and an outflow case provided with an outlet pipe, and is attached to an attached target at two attachment points mutually spaced in the axial direction of the cases. At one of the two attachment points, which is defined on the catalyst case, the catalyst case is firmly fixed. At the other attachment point, which is defined on the filter case, the filter case is attached slidably in the axial direction.

11 Claims, 5 Drawing Sheets

(51) Int. Cl.
*F01N 13/18* (2010.01)
*F01N 13/00* (2010.01)

(56) References Cited

U.S. PATENT DOCUMENTS

| | | | | | |
|---|---|---|---|---|---|
| 3,675,398 | A | * | 7/1972 | Giarrizzo | 96/132 |
| 4,484,771 | A | * | 11/1984 | Schulz | 285/368 |
| 5,880,413 | A | * | 3/1999 | Wagner et al. | 181/211 |
| 7,931,119 | B2 | * | 4/2011 | Fujita | 181/228 |
| 2007/0119155 | A1 | * | 5/2007 | Tongu et al. | 60/299 |
| 2009/0158723 | A1 | * | 6/2009 | Riekers et al. | 60/323 |
| 2010/0269494 | A1 | * | 10/2010 | Saito et al. | 60/311 |
| 2010/0275588 | A1 | * | 11/2010 | Kamata et al. | 60/322 |

FOREIGN PATENT DOCUMENTS

| | | | | | |
|---|---|---|---|---|---|
| JP | 2003104071 | A | * | 4/2003 | B60K 13/04 |
| JP | 2004-340114 | A | | 12/2004 | |
| JP | 2004340114 | A | * | 12/2004 | F01N 7/00 |
| JP | 2008-31955 | A | | 2/2008 | |
| JP | 2009091982 | A | * | 4/2009 | |
| JP | 2010-043576 | A | | 2/2010 | |
| JP | 2010-071180 | A | | 4/2010 | |

* cited by examiner

EXHAUST GAS PURIFYING DEVICE FOR INTERNAL COMBUSTION ENGINE

CROSS REFERENCE TO RELATED APPLICATIONS

This application claims priority to Application No. PCT/JP2010/054932 filed on Mar. 23, 2010, which application claims priority to Japanese Application No. 2009-076698, filed on Mar. 26, 2009. The entire contents of the above applications are incorporated herein by reference in their entireties.

TECHNICAL FIELD

The present invention relates to an exhaust aftertreatment device for an internal combustion engine, in particular, to an exhaust gas purifying device having an exhaust aftertreatment device housed in a cylindrical case.

BACKGROUND ART

Typically, particulate matter in an exhaust gas discharged from an internal combustion engine such as a diesel engine is captured through a soot filter provided by a columnar carrier. There has been known an exhaust gas purifying device in which such an exhaust aftertreatment device (e.g., a soot filter) is housed in a cylindrical case (Patent Literature 1).

An exhaust gas purifying device disclosed in Patent Literature 1 is attached to an engine, an engine hood or a vehicle frame by fitting a U-bolt on the case or via a bracket fixed to the case by welding or the like.

CITATION LIST

Patent Literature

Patent Literature 1: JP-A-2003-120277

SUMMARY OF THE INVENTION

Problems to be Solved by the Invention

When an exhaust gas purifying device is used not in, for instance, an automobile or a truck intended to run on a public road but in a vehicle with a large displacement such as a construction machine, an increase in the size and weight of the exhaust gas purifying device is inevitable. Thus, when the exhaust gas purifying device is attached by using U-bolts only, attachment strength is not sufficient and thus the position of the exhaust gas purifying device is shifted during operation. A reliably attachment cannot be achieved. This problem is particularly eminent in a vehicle with an engine mounted on a revolving frame, such as a hydraulic excavator.

The exhaust aftertreatment device housed in the exhaust gas purifying device is heated to a high temperature with an exhaust gas. In particular, when a soot filter is employed as the exhaust aftertreatment device, captured particulate matter should be combusted to regenerate the soot filter, so that the exhaust aftertreatment device is heated to a high temperature due to the combustion temperature and thus the case in which the exhaust aftertreatment device is housed is thermally expanded. Thus, when the case is firmly fixed via a bracket welded to the case, a dimensional change due to the thermal expansion cannot be accepted and the resulting thermal stress generated in the case decreases the durability of the case.

An object of the invention is to provide an exhaust gas purifying device for an internal combustion engine, which is reliably attachable and in which generation of thermal stress is prevented to improve durability.

Means for Solving the Problems

According to an aspect of the invention, an exhaust gas purifying device for an internal combustion engine, includes: an exhaust aftertreatment device; and a cylindrical case in which the exhaust aftertreatment device is housed, in which the case is attached to an attached target at least first and second attachment points being spaced from each other in an axial direction of the case, the case is fixed to be restricted from sliding in the axial direction at the first attachment point while being attached slidably in the axial direction at the second attachment point, the exhaust aftertreatment device is a soot filter that captures particulate matter in an exhaust gas, the first attachment point is located upstream of the soot filter, the second attachment point is located downstream of the soot filter, a flange provided on an outer circumference of the case is attached to the attached target via an attachment plate at the first attachment point, and reinforcing plates are attached to first and second sides of the flange to be mutually opposed with the flange being interposed therebetween, one of the reinforcing plates being attached to the first side near a top thereof, three of the reinforcing plates being attached to the second side of the flange.

In this aspect, the "attached target" is an internal combustion engine or a hood that covers the internal combustion engine. The expression "attached to the attached target" includes being attached to the attached target via, for instance, an attachment bracket having a certain shape. The expression "the case is firmly fixed" means that the case is fixed by welding, bolting or the like to be restricted from sliding in the axial direction. When a plurality of cases are used, as long as the exhaust aftertreatment device is housed in at least one of the cases, it does not matter whether or not another exhaust aftertreatment device is housed in any other case. Additionally, it can be determined as desired which ones of the cases are provided with the attachment points.

In the exhaust gas purifying device, it is preferable that the attachment plate is attached to the attached target via an attachment bracket at the first attachment point, the attachment bracket includes: a bottom plate; and a pair of support plates being arranged side by side in a line on the bottom plate and on which the attachment plate is fixed, and respective facing portions of support plates are opposed to each other and are curved down onto the bottom plate.

In the exhaust gas purifying device, it is preferable that the attachment bracket is attached to the attached target via a base plate, and a thin plate-like sheet member is interposed between the bottom plate of the attachment bracket and the base plate.

In the exhaust gas purifying device, it is preferable that a U-bolt is wound around an outer circumferential surface of the case at the second attachment point to attach the case to the attached target.

According to the aspect of the invention, the exhaust gas purifying device is attached to the attached target at the two attachment points. The exhaust gas purifying device is firmly fixed at one of the two attachment points, so that the exhaust gas purifying device can be reliably fixed. On the other hand, the case is slidably attached at the other attachment portion, so that a dimensional change in the case due to the thermal expansion thereof can be accepted, thereby preventing generation of thermal stress to improve durability.

The downstream side of the soot filter is heated to a high temperature by combusting captured particulate matter for regenerating the soot filter, so that the case in which such a heated portion of the soot filter is housed suffers a considerable thermal expansion. In view of the above, the first attachment point at which the case is firmly fixed is located at the upstream side of the soot filter while the second attachment point at which the case is slidably attached is located at the downstream side of the soot filter, thereby effectively dealing with the thermal expansion.

At the first point, the flange provided on the case is used for fixing the case, so that it is not necessary to fix an attachment plate on the outer circumferential surface of the case by welding or the like. Since the outer circumferential surface is prevented from being deformed due to the heat of the welding, the holding force of the case for holding therein the exhaust aftertreatment device, a catalyst and the like is not reduced as a result of such deformation and thus these elements can be reliably held.

At the second attachment point, the U-bolt is used to hold the case. Thus, while the position of the cylindrical case is retained in the radial direction thereof, the case can be reliably slidable in the axial direction thereof.

The attachment bracket, to which the attachment plate is attached, includes the pair of support plates. The respective facing portions of the support plates are curved. With this arrangement, stress concentration generated in the facing portions can be reduced to further improve durability.

With the thin plate-like sheet member interposed between the attachment bracket and the base plate, the attachment bracket and the base plate can be fixed to each other without rattling. Thus, flatness can be readily ensured and thus the case can be stably attached.

DESCRIPTION OF EXEMPLARY EMBODIMENT

An exemplary embodiment of the invention will be described below with reference to the attached drawings.

Figure 1:
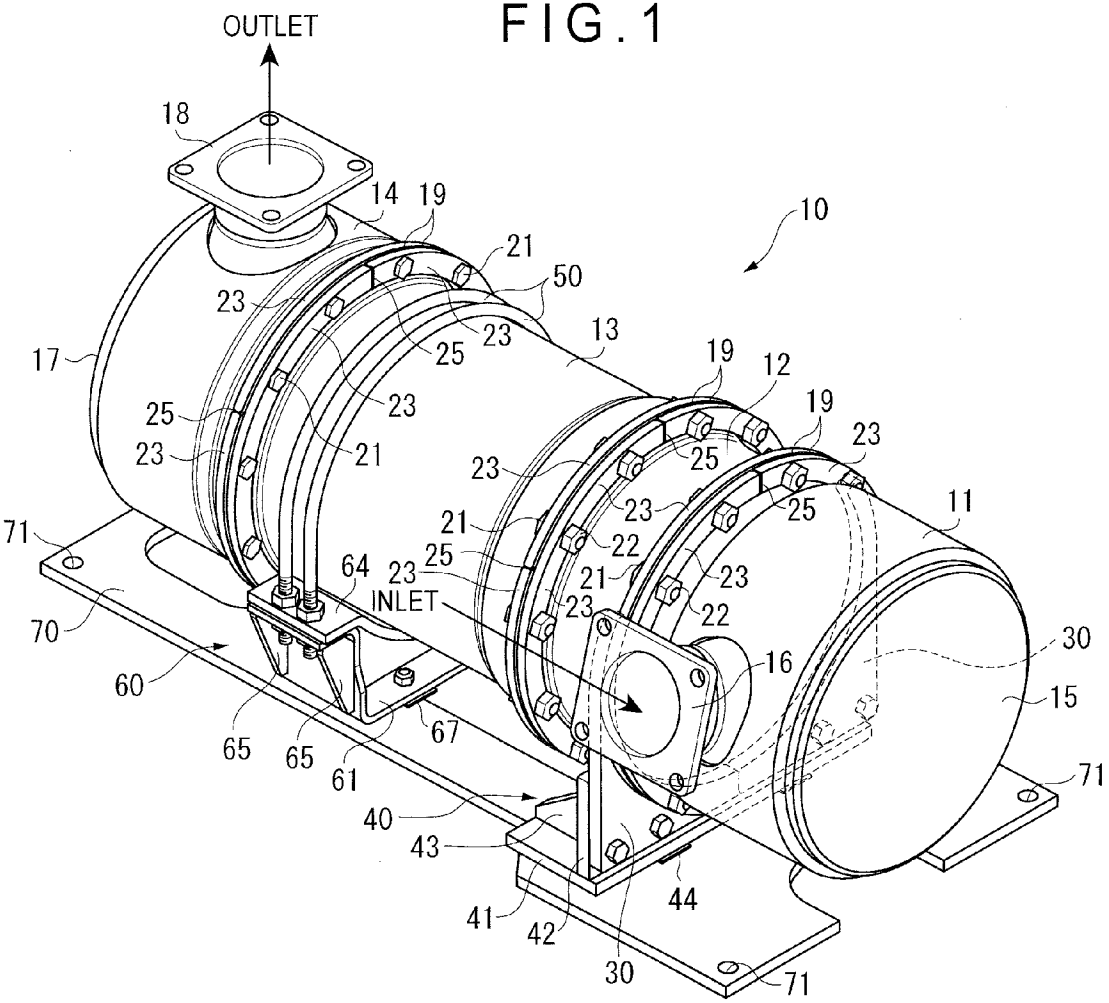
FIG. 1 is a perspective view showing an entire exhaust gas purifying device according to an exemplary embodiment of the invention.

FIG. 1 is a perspective view showing an entire exhaust gas purifying device 10 according to the exemplary embodiment. The exhaust gas purifying device 10 is intended to capture particulate matter in an exhaust gas discharged from an internal combustion engine such as a diesel engine mounted on a vehicle (not shown), and is attached to, for instance, the internal combustion engine, an engine hood of the vehicle on which the internal combustion engine is mounted, or a vehicle frame.

The exhaust gas purifying device 10 according to the exemplary embodiment is intended to be used for a construction machine such as a hydraulic excavator, and thus is significantly large in size as compared with one intended to be used for a general transportation truck. The exhaust gas purifying device 10 includes a plurality of mutually separable cylindrical members, for instance, four cases 11, 12, 13 and 14.

An inflow case 11 is provided at an exhaust-gas inlet side. One end of the inflow case 11 in the axial direction is closed by a lateral wall 15. The inflow case 11 is provided with an inlet pipe 16 through which an exhaust gas flows into the inflow case 11 perpendicularly to the axial direction. The inlet pipe 16 is coupled to an exhaust-gas outlet pipe of a turbocharger (not shown) mounted on the internal combustion engine via a vibration suppressing member provided by a pipe coupler (e.g., a bellows tube or a universal joint) that allows a connection angle to be variable. The vibration suppressing member serves to suppress mutual influence between the turbocharger and the exhaust gas purifying device 10 due to their different vibration modes. The exhaust gas discharged from the turbocharger flows into the inflow case 11 through the inlet pipe 16, and is directed toward a catalyst case 12 at the side opposite to the lateral wall 15.

The catalyst case 12 is cylindrical. An oxidizing catalyst (exhaust aftertreatment device) is housed in the catalyst case 12. The oxidizing catalyst serves to oxidize a dosing fuel added to the exhaust gas as needed to generate heat therefrom so that the temperature of the exhaust gas is raised to a predetermined high-temperature range. The dosing fuel is added to the exhaust gas by a dosing fuel injector provided to an exhaust pipe connecting the exhaust-gas outlet side of the turbocharger and the exhaust-gas inlet side of the exhaust gas purifying device 10, and then flows into the exhaust gas purifying device 10 along with the exhaust gas.

In the instance where the internal combustion engine is a diesel engine, the dosing fuel is, for instance, a light oil in the same manner as the engine fuel. In the instance where the dosing fuel is fed into a cylinder, an engine fuel injector is used to feed the dosing fuel, too.

A cylindrical filter case 13 is located downstream of the catalyst case 12. As compared with the other cases 11, 12 and 14, the filter case 13 is the longest in the axial direction. A soot filter (exhaust aftertreatment device) for capturing particulate matter is housed in the filter case 13. The soot filter (a detailed description thereof is omitted) is provided by a carrier of cordierite, silicon carbide or the like. The exhaust gas passes through a number of through holes formed in the carrier along the axial direction of the carrier to be captured.

Incidentally, the exhaust aftertreatment device is not limited to a soot filter for capturing particulate matter, but may be an exhaust aftertreatment device for reducing NOx emission, for instance, a NOx reduction catalyst, a NOx storage reduction catalyst, a three-way catalyst, or any other oxidizing catalyst. Alternatively, such an exhaust aftertreatment device for reducing NOx and the exhaust aftertreatment device for capturing particulate matter may be arranged in series to be used in combination.

In the instance of using only the exhaust aftertreatment device for reducing NOx, the oxidizing catalyst for oxidizing the dosing fuel as used in this exemplary embodiment is omitted. In other words, the oxidizing catalyst and the soot filter are used in pairs. The heat of the exhaust gas heated through the oxidizing catalyst is used to combust the particulate matter captured by the soot filter to regenerate the soot filter. For the necessity of such regeneration, the oxidizing catalyst is provided in the exemplary embodiment. The soot filter may alternatively be attached with such an oxidizing catalyst. If so, as long as the soot filter is singularly used, it is not necessary to provide a separate oxidizing catalyst.

An outflow case 14 is located downstream of the filter case 13. The other end of the outflow case 14 in the axial direction is closed by a lateral wall 17. The outflow case 14 is provided with an outlet pipe 18 for discharging an exhaust gas. The outlet pipe 18 vertically projects and has an end to which a muffler cutter (not shown) is connected. In this exemplary embodiment, the exhaust gas purifying device 10 also functions as a silencing muffler, so that a separate silencing muffler is not particularly necessary and thus the muffler cutter can be directly attached to the exhaust gas purifying device 10.

When regeneration of the soot filter is not necessary, no dosing fuel is contained in the exhaust gas flowing from the inflow case 11 into the catalyst case 12. The exhaust gas simply passes through the oxidizing catalyst to flow into the soot filter inside the filter case 13 and thus particulate matter in the exhaust gas is captured to purify the exhaust gas. The purified exhaust gas is directed into the outflow case 14 at the downstream side and is discharged from the outflow case 14 through the outlet pipe 18 and the muffler cutter.

In contrast, when the soot filter is accumulated with particulate matter to be clogged, a dosing fuel is injected to the exhaust gas by the fuel injector. The fuel in the exhaust gas is oxidized through the oxidizing catalyst inside the catalyst case 12 to generate heat, so that the exhaust gas passing through the oxidizing catalyst is heated to or higher than a predetermined temperature, i.e., a temperature for regenerating the soot filter. When the exhaust gas heated to or higher than the temperature for regeneration flows into the soot filter at the downstream side, the particulate matter accumulated on the soot filter is combusted with the heat of the exhaust gas to become harmless and is discharged out. The particulate matter is removed from the soot filter, so that the soot filter is regenerated to the original condition.

Incidentally, when the temperature of the exhaust gas has reached or exceeded the temperature for regeneration without feeding the dosing fuel, particulate matter captured by the soot filter is combusted with the heat of the exhaust gas irrespective of how much the soot filter is clogged, so that the soot filter is regenerated by itself without any dosing fuel.

Figure 2:
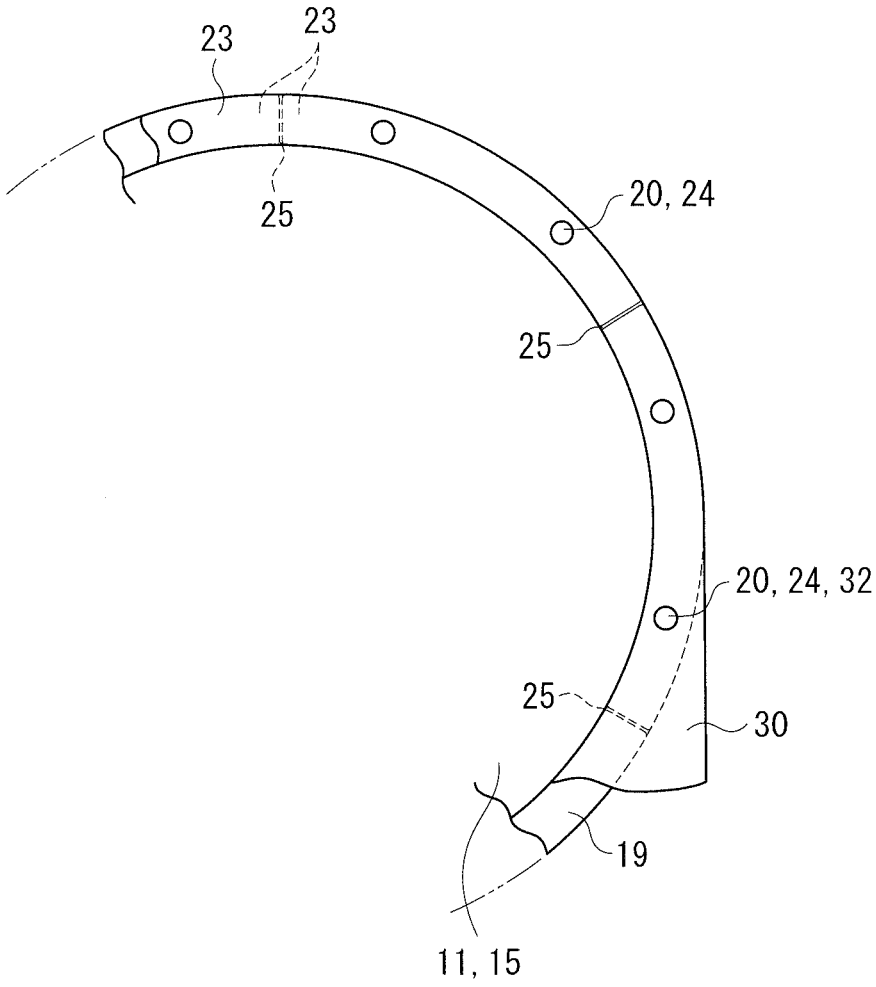
FIG. 2 is a view of the exhaust gas purifying device as observed in an axial direction from one side to the other side.

FIG. 2 is a view of the exhaust gas purifying device 10 as observed in the axial direction from one side to the other side. Referring to FIGS. 1 and 2, flanges 19 are provided around openings of the cases 11 to 14 at joints therebetween, the flanges 19 each extending radially outward and being circumferentially continuous. These flanges 19 are provided integrally with the cases 11 to 14 by flanging on cylindrical bodies forming the outer circumferential surfaces of the cases 11 to 14. The flanges 19 of the cases 11 to 14 are brought into abutment with one another and then the cases 11 to 14 are coupled together by using bolts 21 inserted through respective bolt holes 20 of the flanges 19 and nuts 22 screwed thereon.

Each flange 19 has a thickness identical to that of the cylindrical body, and thus does not have a sufficient rigidity. In view of the above, according to this exemplary embodiment, a plurality of reinforcing plates 23 are arranged on each flange 19 along the entire circumference thereof for reinforcement. Each reinforcing plate 23 is in an arc shape having a length of one third of the circumference of the flanges 19. The reinforcing plates 23 are arranged in a circle to reinforce each flange 19 over the entire circumference thereof. Specifically, each reinforcing plate 23 is likewise provided with bolt holes 24, so that the bolts 21 are inserted through the respective bolt holes 20 and 24.

The positions of opposed ones of the reinforcing plates 23, between which an abutting pair of flanges 19 is interposed, are circumferentially shifted from each other. Boundaries 25 between circumferentially adjacent ones of the reinforcing plates 23 are thus not opposed to each other with the pair of flanges 19 being interposed therebetween. If the boundaries 25 are mutually opposed in the axial direction with the pair of flanges 19 being interposed therebetween, a gasket contact pressure generated in the flanges 19 by tightening the bolts 21 and the nuts 22 becomes low at portions corresponding to the boundaries 25, so that leakage of the exhaust gas is likely to occur. Accordingly, in order to equalize the gasket contact pressure, the reinforcing plates 23 are arranged as described above in this exemplary embodiment.

A detailed description will be made below on an attachment structure for the exhaust gas purifying device 10. The exhaust gas purifying device 10 is attached at two points, i.e., first and second points, spaced from each other in the axial direction by using attachment plates 30 and a pair of U-bolts 50, respectively.

Figure 3:
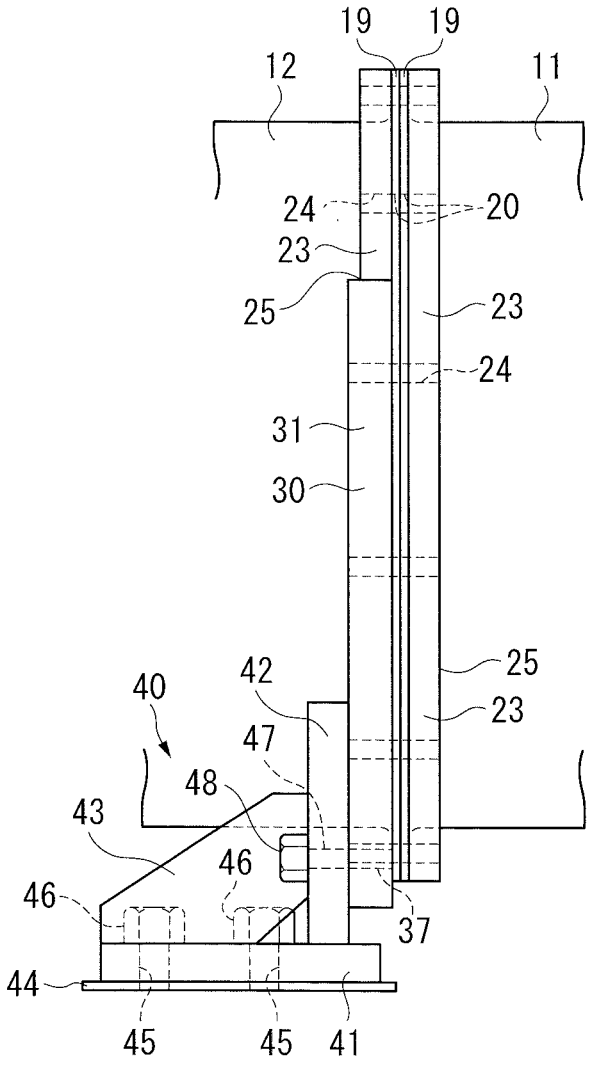
FIG. 3 is a view showing a primary part of the exhaust gas purifying device.
Figure 4:
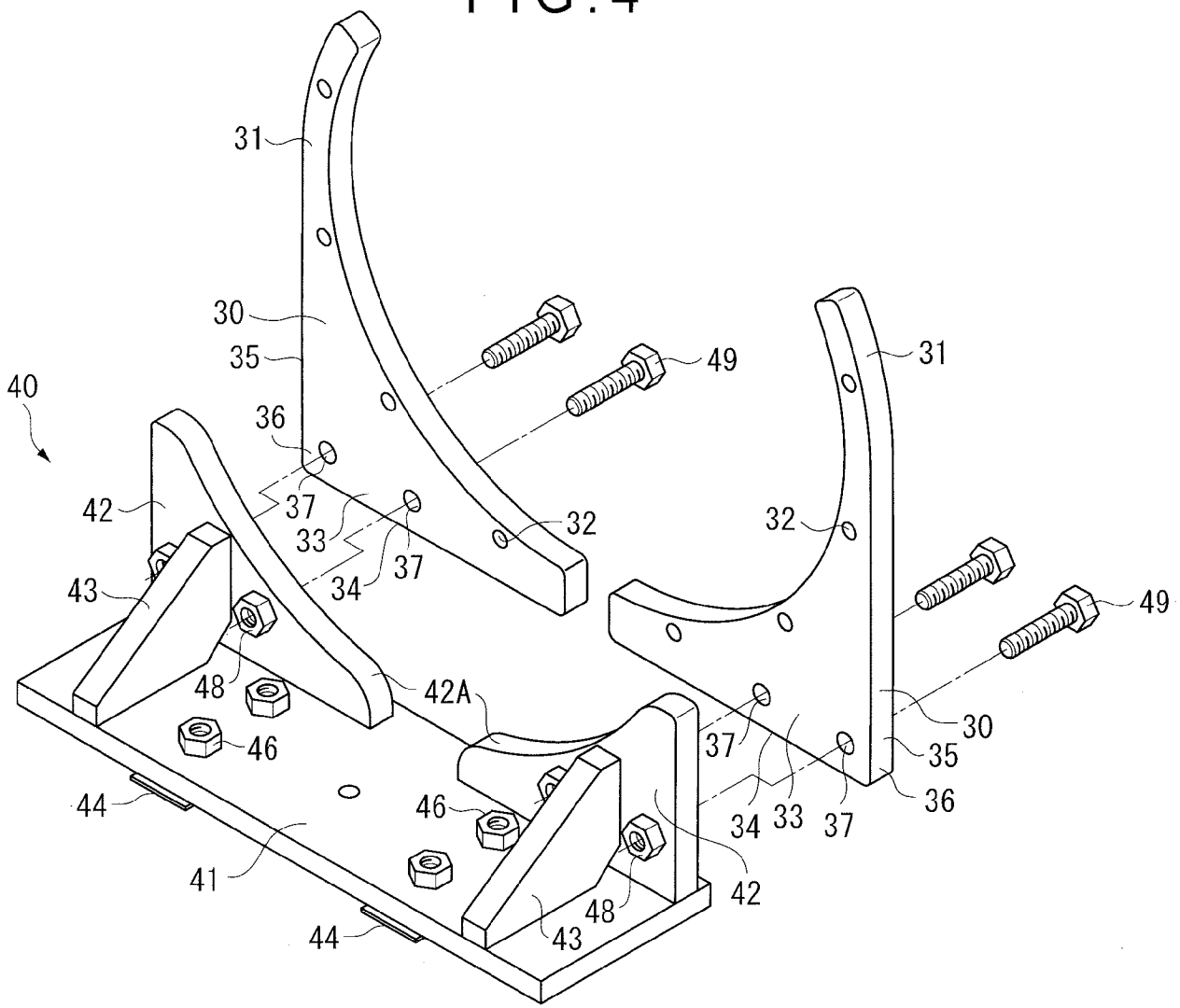
FIG. 4 is an exploded perspective view showing the primary part.
Figure 5:
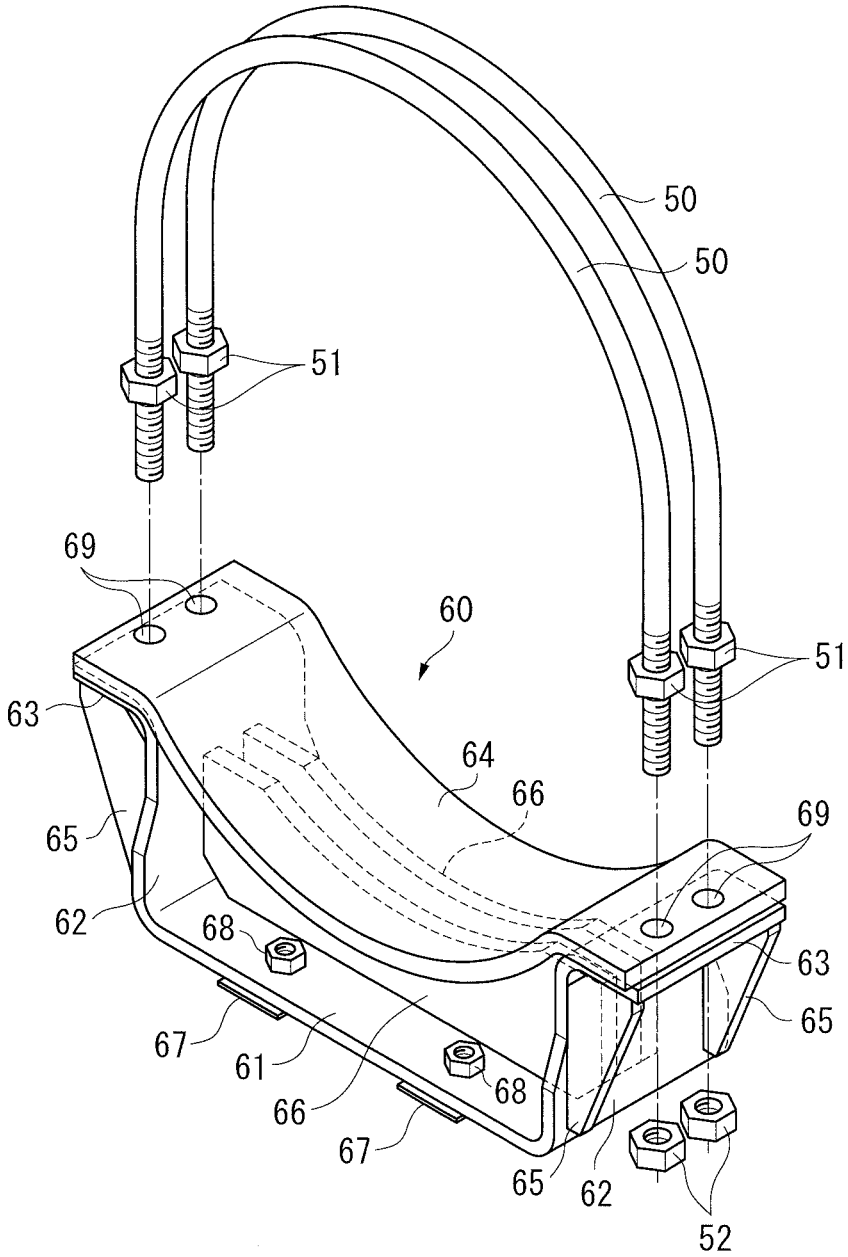
FIG. 5 is an exploded perspective view showing another primary part of the exhaust gas purifying device.

The attachment plates 30, which are used at the first attachment point, are fixed to the flange 19 of the catalyst case 12 at an exhaust-gas inflow side as shown in FIGS. 3 and 4. Specifically, this flange 19 of the catalyst case 12 is provided with only one of the reinforcing plates 23, which is located at an upper portion of the flange 19, while the attachment plates 30 are provided at positions corresponding to the other two reinforcing plates 23, respectively.

Accordingly, each attachment plate 30 includes an attachment portion 31 formed along the outer circumferential surface of the catalyst case 12. The attachment portion 31 is provided with a plurality of bolt holes 32 at positions along an arc shape. The bolts 21 are inserted through the respective bolt holes 32 and then the nuts 22 are screwed onto the respective bolts 21, thereby tightening the attachment plates 30 together with the flange 19. Thus, the attachment plates 30 can be used to fix the exhaust gas purifying device 10 while functioning as the reinforcing plates 23 for coupling the catalyst case 12 to the inflow case 11.

Each attachment plate 30 also includes an attachment piece 33 formed integrally with the attachment portion 31. The attachment piece 33 has a corner 36 formed between a pair of edges 34 and 35 that intersect with each other at a substantially right angle. The attachment piece 33 is provided with a pair of bolt holes 37 along the lower edge 34. The thickness of the attachment plates 30 is larger than that of the reinforcing plates 23, so that the attachment plates 30 have an attachment strength sufficient not only for reinforcing the flange 19 but also for attaching the exhaust gas purifying device 10.

These attachment plates 30 are bolted to a first attachment bracket 40.

The first attachment bracket 40 includes a bottom plate 41 having a rectangular shape in plan view, a pair of support plates 42 being arranged side by side in a line along a long side of the bottom plate 41, and ribs 43 that abut against vertical surfaces of the support plates 42 and an upper surface of the bottom plate 41.

A pair of sheet members 44 shaped like rectangular thin plates is arranged on a lower surface of the bottom plate 41 in parallel along a short side of the bottom plate 41. The bottom plate 41 is also provided with bolt holes 45 (FIG. 3), which also penetrate through the respective sheet members 44. Nuts 46 corresponding to the bolt holes 45 are fixed on the upper surface of the bottom plate 41.

Support plates 42 are provided with bolt holes 47 corresponding to the bolt holes 37 of the attachment plates 30. Nuts 48 corresponding to the bolt holes 47 are fixed on the surfaces of support plates 42 opposite to the surfaces on which the attachment plates 30 are located. The attachment plates 30 are brought into abutment with the respective support plates 42 and then bolts 49 are inserted through the respective bolt holes 37 and 47 to be screwed into the respective nuts 48, thereby fixing the plates 30 and 42. Since the bolt holes 47 are arranged substantially in a line at the same level, an adjustable margin is ensured for a position shift in the up-and-bottom direction in the figure caused when the attachment plates 30 are bolted to the respective support plates 42.

The upper surfaces of these support plates 42, which are shaped along the contour of the catalyst case 12, are inclined downward as being closer to each other. Facing portions 42A of the support plates 42 are curved down onto the bottom plate 41. Since the adjacent facing portions 42A of the support plates 42 are rounded, it is possible to reduce stress generated particularly in the facing portions 42A when the exhaust gas purifying device 10 is supported via the attachment plates 30, so that durability can be improved.

The bottom plate 41 of the first attachment bracket 40 is mounted on a base plate 70 near one end of the base plate 70 via the sheet members 44 as shown in FIG. 1. Bolts (not shown) are then inserted through the respective bolt holes 45 from the lower side of the base plate 70 to be screwed into the respective nuts 46, thereby fixing the bottom plate 41 to the base plate 70. Bolts (not shown) are inserted through respective bolt holes 71 formed in the base plate 70 at corners thereof to fix the base plate 70 to, for instance, an upper portion of the internal combustion engine (e.g., an upper portion of a flywheel housing of a diesel engine).

Thus, the flange 19 of the catalyst case 12 is used to firmly fix the exhaust gas purifying device 10 to the internal combustion engine at the first point via the attachment plates 30, the first attachment bracket 40 and the base plate 70.

With this arrangement, as compared with fixation using U-bolts only, attachment strength can be improved, so that the position of the exhaust gas purifying device 10 is not shifted even during the operation of the construction machine. The exemplary embodiment can thus achieve a more reliable fixation.

Since the bracket for attachment is not directly welded to the catalyst case 12 and the filter case 13 but is fixed to the flange 19 by using the attachment plates 30, each of the cases 12 and 13 requires no margin for welding. Thus, an increase in the size of the exhaust gas purifying device 10 in the axial direction can be prevented.

Additionally, omission of welding results in avoidance of a slight thermal deformation in the outer circumferential surface of each of the cases 12 and 13, so that the oxidizing catalyst and the soot filter housed therein can be stably held. Further, since welding is omitted, the outer circumferential surface of each of the cases 12 and 13 is not required to be partly resistive to thermal deformation caused during welding. Thus, complication of the structure of each of the cases 12 and 13 can be prevented.

The sheet members 44 interposed between the first attachment bracket 40 and the base plate 70 enable the first attachment bracket 40 and the base plate 70 to favorably firmly contact with each other to ensure the flatness of the exhaust gas purifying device 10, so that the exhaust gas purifying device 10 can be attached in a preferred posture.

In contrast, the pair of U-bolts 50, which is used at the second attachment position, is wound around the filter case 13 near the outflow end thereof to hold the filter case 13. Both ends of each U-bolt 50 are inserted through a second attachment bracket 60 and are attached to the second attachment bracket 60 by using nuts 51 and 52, the nuts 51 being previously screwed onto the U-bolts 50, the nuts 52 being screwed onto the U-bolts 50 after the insertion.

The second attachment bracket 60 includes a bottom plate 61 having upright portions 62 at both ends thereof, a curved plate 64 that connects support pieces 63 provided to upper ends of the upright portion 62 to each other, ribs 65 that abut against the support pieces 63 and the upright portions 62, and support plates 66 that support facing surfaces of the upright portions 62 and a rear surface of the curved plate 64.

A pair of sheet members 67 is arranged on a lower surface of the bottom plate 61 in the same manner as the bottom plate 41 of the first attachment bracket 40. The bottom plate 61 is provided with a plurality of bolt holes (not shown), which also penetrate through the sheet members 67. Nuts 68 corresponding to the bolt holes are fixed on the bottom plate 61. Each of both ends of the curved plate 64 is provided with a pair of bolt holes 69, which also penetrate through the support piece 63. Ends of the U-bolts 50 are inserted through the respective bolt holes 69.

The bottom plate 61 of the second attachment bracket 60 is mounted on the base plate 70 near the other end of the base plate 70 via the sheet members 67. Bolts (not shown) are then inserted through the respective bolt holes from the lower side of the base plate 70 to be screwed into the respective nuts 68, thereby fixing the bottom plate 61 to the base plate 70.

Thus, by using the U-bolts 50, the exhaust gas purifying device 10 is attached to the internal combustion engine at the second point via the second attachment bracket 60 and the base plate 70. The U-bolts 50 serve to urge the filter case 13 in the radial direction against the second attachment bracket 60 to hold the filter case 13, so that the position of the filter case 13 is restricted in the radial direction while being not completely restricted in the axial direction. Thus, the filter case 13 is attached slidably in the axial direction.

With the above arrangement of the exemplary embodiment, even though, in particular, the exhaust-gas outflow end of the filter case 13 is heated to a higher temperature with combustion heat generated by combusting particulate matter for regenerating the soot filter inside the filter case 13, and thus suffers thermal expansion along the axial direction, this end of the filter case 13, which is attached slidably in the axial direction by using the U-bolts 50, can absorb a dimensional change resulting from the thermal expansion, so that damages and a reduction in durability due to thermal stress can be prevented.

In the exhaust gas purifying device 10 attached as described above, when ash or the like, which cannot be eliminated even through the combustion for regenerating the soot filter, is accumulated in the soot filter, it is necessary to remove the filter case 13 from the exhaust gas purifying device 10 and again set the filter case 13 in the exhaust gas purifying device 10 after cleaning, or to replace the filter case 13 along with the soot filter housed therein.

For replacing the filter case 13, first of all, the bolts 49 of the first attachment bracket 40 are removed from the respective nuts 48 and the U-bolts 50 and the nuts 52 are removed from the second attachment bracket 60. The exhaust gas purifying device 10 is then removed from the internal combustion engine. The catalyst case 12 and the filter case 13 are separated from each other. The cases 12 and 13 can be separated by removing the bolts 21 and the nuts 22 used to couple the flanges 19 of the cases 12 and 13. The outflow case 14 is likewise separated to remove the filter case 13. Subsequently, the filter case 13 is opened to perform a necessary operation thereon. The cases 11, 12, 13 and 14 can be assembled in the reverse order of the above.

Although the best arrangements, methods and the like for carrying out the invention are disclosed above, the invention is not limited thereto. In other words, while the invention has been particularly explained and illustrated mainly in relation to specific embodiment, a person skilled in the art could make various modifications in terms of shape, quantity or other particulars to the above described embodiment without deviating from the technical idea or any object of the invention.

Accordingly, any descriptions of shape or quantity or the like disclosed above are given as examples to enable easy understanding of the invention, and do not limit the invention, so that descriptions using names of components, with any such limitations of shape or quantity or the like removed in part or whole, are included in the invention.

Although the catalyst case 12 is fixed via the attachment plates 30 while the filter case 13 is slidably attached by using the U-bolts 50 in the exemplary embodiment, which ones of the cases 11 to 14 should be attached and how the cases should be attached may be determined in consideration of the type or the like of an exhaust aftertreatment device housed therein.

Specifically, as long as the exhaust gas purifying device is firmly fixed at one of the attachment points defined in the longitudinal direction thereof while being slidably attached at the other attachment point so that thermal expansion is acceptable, the cases may be attached in any way without departing the scope of the invention. In other words, for instance, the first attachment bracket 40 may be directly welded to the catalyst case 12 without departing the scope of the invention.

In place of using the U-bolts 50, a metallic band or the like may be used to attach the filter case 13 to the second attachment bracket 60 or, alternatively, a horizontal attachment piece, which is previously welded to the filter case 13, and an end of the second attachment bracket 60 may be vertically cramped together. In either case, the sliding in the axial direction is acceptable while the sliding in the radial direction is restricted.

Although the attachment plates 30 and the U-bolts 50 are attached to the first and second attachment brackets 40 and 60, respectively, and the first and the second attachment brackets 40 and 60 are attached to an attached target, such as an internal combustion engine, a hood that covers the internal combustion engine and a vehicle frame, via the base plate 70 in the exemplary embodiment, the attachment plates 30 and the U-bolts 50 may be directly attached to the attached target without using the first and second attachment brackets 40 and 60 and the base plate 70 without departing the scope of the invention.

The invention claimed is:

1. An exhaust gas purifying device for an internal combustion engine, comprising:

a soot filter that captures particulate matter in an exhaust gas; and a cylindrical case in which the soot filter is housed, wherein the case is attached to an attached target at first and second attachment points that are spaced from each other in an axial direction of the case, the case is fixed to be restricted from sliding in the axial direction at the first attachment point while being attached slidably in the axial direction at the second attachment point, the first attachment point is located upstream of the soot filter, the second attachment point is located downstream of the soot filter, a flange provided on an outer circumference of the case is attached to the attached target via an attachment plate at the first attachment point, reinforcing plates are attached to first and second sides of the flange to be mutually opposed with the flange being interposed therebetween, one of the reinforcing plates being attached to the first side near a top of the first side, the attachment plate being attached to the first side near a bottom of the first side relative to the one of the reinforcing plates, three of the reinforcing plates being attached to the second side of the flange along an entire circumference of the flange, the attachment plate is attached to the attached target via an attachment bracket at the first attachment point, the attachment bracket comprising:

a bottom plate, and a pair of support plates arranged side by side along a line across a top surface of the bottom plate and fixed to the attachment plate, the pair of support plates having respective facing portions that are opposed to each other and curved down onto the bottom plate, the attachment bracket is attached to the attached target via a base plate, and a thin plate-like sheet member is interposed between the bottom plate of the attachment bracket and the base plate.

2. The exhaust gas purifying device according to claim 1, wherein a U-bolt is wound around an outer circumferential surface of the case at the second attachment point to attach the case to the attached target.

3. The exhaust gas purifying device according to claim 1, wherein positions of boundaries between the one of the reinforcing plates and the attachment plate attached to the first side of the flange are circumferentially shifted from positions of boundaries between the reinforcing plates attached to the second side of the flange.

4. An exhaust gas purifying device for an internal combustion engine, comprising:

an exhaust aftertreatment device that captures particulate matter in an exhaust gas; and a cylindrical case in which the exhaust aftertreatment is housed, wherein the case is attached to an attached target at least first and second attachment points being spaced from each other in an axial direction of the case, the case is fixed to be restricted from sliding in the axial direction at the first attachment point while being attached slidably in the axial direction at the second attachment point, the first attachment point is located upstream of the exhaust aftertreatment device, the second attachment point is located downstream of the exhaust aftertreatment device, a flange provided on an outer circumference of the case is attached to the attached target via an attachment plate at the first attachment point, reinforcing plates are attached to first and second sides of the flange to be mutually opposed with the flange being interposed therebetween, wherein the attachment plate and at least one of the reinforcing plates are attached to the first side of the flange along a circumference of the flange, the attachment plate and the at least one of the reinforcing plates being disposed circumferentially adjacent to each other to define boundaries between corresponding adjacent side surfaces of the attachment plate and the at least one of the reinforcing plates, and wherein a plurality of the reinforcing plates are attached to the second side of the flange along a circumference of the flange, the plurality of the reinforcing plates being disposed circumferentially adjacent to each other to define boundaries between corresponding adjacent side surfaces of the plurality of the reinforcing plates, and the attachment plate is attached to the attached target via an attachment bracket at the first attachment point, the attachment bracket comprising:

a bottom plate, and a pair of support plates arranged side by side along a line across a top surface of the bottom plate and fixed to the attachment plate, the pair of support plates having respective facing portions that are opposed to each other and curved down onto the bottom plate.

5. The exhaust gas purifying device according to claim 4, wherein the attachment bracket is attached to the attached target via a base plate, and a thin plate-like sheet member is interposed between the bottom plate of the attachment bracket and the base plate.

6. The exhaust gas purifying device according to claim 4, wherein the attachment plate and the at least one of the reinforcing plates are attached to the first side of the flange along an entire circumference of the flange.

7. The exhaust gas purifying device according to claim 4, wherein the plurality of the reinforcing plates are attached to the second side of the flange along an entire circumference of the flange.

8. The exhaust gas purifying device according to claim 4, wherein a U-bolt is wound around an outer circumferential surface of the case at the second attachment point to attach the case to the attached target.

9. The exhaust gas purifying device according to claim 4, wherein positions of the boundaries between the attachment plate and the at least one of the reinforcing plates attached to the first side of the flange are circumferentially shifted from positions of the boundaries between the reinforcing plates attached to the second side of the flange.

10. The exhaust gas purifying device according to claim 4, wherein the exhaust aftertreatment device is a soot filter.

11. The exhaust gas purifying device according to claim 4, wherein the first and second sides of the flange are opposing sides of an abutting pair of flanges.

* * * * *